US007962073B2

(12) United States Patent
Kobayashi et al.

(10) Patent No.: US 7,962,073 B2
(45) Date of Patent: Jun. 14, 2011

(54) IMAGE FORMING APPARATUS WITH DEVELOPING UNIT HAVING A MAGNETIC BRUSH

(75) Inventors: Kazutoshi Kobayashi, Tokyo (JP); Yutaka Miyasaka, Tokyo (JP); Nobuyasu Tamura, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 712 days.

(21) Appl. No.: 12/015,106

(22) Filed: Jan. 16, 2008

(65) Prior Publication Data

US 2008/0240793 A1 Oct. 2, 2008

(30) Foreign Application Priority Data

Mar. 27, 2007 (JP) ..... 2007-081186

(51) Int. Cl.
*G03G 15/09* (2006.01)

(52) U.S. Cl. ..... 399/270; 399/277

(58) Field of Classification Search ..... 399/267, 399/270, 277

See application file for complete search history.

(56) References Cited

U.S. PATENT DOCUMENTS 5,860,049 A * 1/1999 Kumasaka et al. ..... 399/267
6,449,452 B1 * 9/2002 Kai ..... 399/267
6,721,526 B2 * 4/2004 Shigeta et al. ..... 399/267
6,947,692 B2 * 9/2005 Kondo et al. ..... 399/277

FOREIGN PATENT DOCUMENTS

JP 2002-72690 A 3/2002
JP 2003-330277 A 11/2003

OTHER PUBLICATIONS

Japanese Office Action for Japanese Patent Application No. 2007-081186 mailed on Apr. 14, 2009 with English translation.

* cited by examiner

*Primary Examiner* — William J Royer
(74) *Attorney, Agent, or Firm* — Cantor Colburn LLP

(57) ABSTRACT

An image forming apparatus having an image carrier for forming an electrostatic latent image and a developing unit for developing the electrostatic latent image with a two-component developing agent, the developing unit includes: a developing agent carrier for developing the electrostatic latent image to form a visible image, having inside thereof a development main magnetic pole for forming a bristle of a magnetic brush; and a plurality of magnetic poles for conveying the developing agent, wherein the developing unit performs a counter type contact developing method, and wherein, a development area is formed so that, a contact width of the bristle of the magnetic brush is 70% or less with respect to a development width, and a center position of the contact width is positioned on an upstream side with respect to a center position of the development width in a rotation direction of the image carrier.

5 Claims, 5 Drawing Sheets

IMAGE FORMING APPARATUS WITH DEVELOPING UNIT HAVING A MAGNETIC BRUSH

BACKGROUND OF THE INVENTION

1. Field of the Invention

The present invention relates to image forming apparatuses such as copying machines, printers, facsimiles, and multi-function peripherals (MFP) with a developing unit that develops an electrostatic latent image on an image carrier using a magnetic brush formed on the surface of a developer carrier.

2. Description of the Related Art

Two-component developers having a magnetic carrier and a toner are being used widely in image forming apparatuses that employ an electrophotographic method. At the time of developing electrostatic charge images, a magnetic brush is formed on the surface of a developer carrier, and a toner image is formed by making this magnetic brush come into contact with and rub against an image carrier.

In recent years, high image quality and high durability are being desired, and, in order to achieve these, measures are being taken such as reducing of the diameter of carrier particles and of the diameter of toner particles in a developing agent, or increasing the thickness of a coated plastic film covering the surface of the carrier particles made of ferrite, and the like, in order to give them charging characteristics. However, if these measures are taken, there is the problem that the amount of charge on the toner particles becomes high thereby reducing the developing characteristics. In view of this, in order to fully utilize the small diameter carrier particles and small diameter toner particles with a high resistance that reduces developing characteristics, it is desirable to use a counter development method with increased development efficiency in which the supply capacity of the developer is increased by conveying the image carrier and the developer carrier in mutually opposite directions at the closest part between them.

When high resistance carrier particles are used in the counter development method, a new problem occurs of "back edge density unevenness in outline characters".

FIG. 8 is a diagram for explaining back edge density unevenness in outline characters.

Outline character back edge density unevenness is an abnormality of reduction in the density because of the density unevenness of the edge part of the bland image positioned at the back edge part of the outline characters formed inside the bland image.

As a proposed countermeasure for outline character back edge density unevenness, a developing unit disclosed in Unexamined Japanese Patent Application Publication No. 2002-72690 (hereinafter referred to as JPA 2002-72690), uses a two-component developing agent, a developing sleeve rotates in a direction opposite to the direction of rotation of a photoreceptor drum, and a bias voltage having superimposed AC voltage and DC voltage is applied to the developing sleeve at the time of development.

In this JPA 2002-72690, in order to provide an image with no sweeping line unevenness in the counter development method, a magnetic field of the carrier/magnetic field intensity and the position of a main development magnetic pole, particle diameter of the carrier, and the toner density have been stipulated.

However, in the developing unit disclosed in JPA 2002-72690, the improvement against outline character back edge density unevenness is insufficient, and in particular, it was found to become a problem when high quality images or outlines are required.

As has been explained above, when high resistance carriers are used in the counter development method, a new problem occurs of "back edge density unevenness in outline characters".

The purpose of the present invention is to further improve outline character back edge density unevenness and to obtain good quality images.

SUMMARY OF THE INVENTION

One aspect of the present invention is to provide an image forming apparatus, the image forming apparatus comprising an image carrier for forming an electrostatic latent image on a surface thereof and a developing unit for developing the electrostatic latent image on said image carrier with a two-component developing agent, the developing unit comprises: a developing agent carrier for developing the electrostatic latent image to form a visible image, wherein said developing agent carrier is disposed opposite to said image carrier with a gap; having inside thereof a development main magnetic pole for forming a bristle of a magnetic brush provided and a plurality of magnetic poles for conveying the developing agent, wherein the developing unit performs a counter type contact developing method in which said image carrier and said developing agent carrier are moved in mutually opposite directions at a development area, the bristle of the magnetic brush is formed by the two-component developing agent on the surface of said developing agent carrier, and an alternating electric field having a DC component and an AC component superimposed on each other is used as a development bias applied to said developing agent carrier, and wherein, the development area is formed so that, a contact width of the bristle of the magnetic brush formed by said development main magnetic pole contacting on said image carrier is 70% or less with respect to a development width in which a toner on the surface of said developing agent carrier is transferred on to said image carrier, and a center position of the contact width is positioned on an upstream side with respect to a center position of the development width in a rotation direction of said image carrier.

Another aspect of the present invention is to provide an image forming apparatus, the image forming apparatus comprising an image carrier for forming an electrostatic latent image on a surface thereof and a developing unit for developing the electrostatic latent image on said image carrier with a two-component developing agent, the developing unit comprises: a developing agent carrier for developing the electrostatic latent image to form a visible image, wherein said developing agent carrier is disposed opposite to said image carrier with a gap; having inside thereof a development main magnetic pole for forming a bristle of a magnetic brush and a plurality of magnetic poles for conveying the developing agent, wherein the developing unit performs a counter type contact developing method in which said image carrier and said developing agent carrier are moved in mutually opposite directions at a development area, the bristle of the magnetic brush is formed by the two-component developing agent on the surface of said developing agent carrier, and an alternating electric field having a DC component and an AC component superimposed on each other is used as a development bias applied to said developing agent carrier, and wherein the development area, in which a toner on the developing agent carrier is transferred on to said image carrier, is formed so that a distance from a surface of the bristle of the magnetic brush at an end part of a downstream side of the development area with respect to a rotation direction of the image carrier to the surface of the image carrier is 200 μm to 1200 μm.

A further aspect of the present invention is to provide an image forming apparatus, the image forming apparatus comprising an image carrier for forming an electrostatic latent image on a surface thereof and a developing unit for developing the electrostatic latent image on said image carrier with a two-component developing agent, the developing unit comprises: a developing agent carrier for developing the electrostatic latent image to form a visible image, wherein said developing agent carrier is disposed opposite to said image carrier with a gap; having inside thereof a development main magnetic pole for forming a bristle of a magnetic brush and a plurality of magnetic poles for conveying the developing agent, wherein the developing unit performs a counter type contact developing method in which said image carrier and said developing agent carrier are moved in mutually opposite directions at a development area, the bristle of the magnetic brush is formed by the two-component developing agent on the surface of said developing agent carrier, and an alternating electric field having a DC component and an AC component superimposed on each other is used as a development bias applied to said developing agent carrier, and wherein said development main magnetic pole is provided upstream of a position in a rotation direction of said image carrier, at which position the surface of the image carrier is closest to the developing agent carrier, and wherein said development main magnetic pole and a developing agent conveying magnetic pole that is next to said development main magnetic pole at an upstream side in a rotation direction of said developing agent carrier make an angle of 25° to 35°, and a half-value width of the developing agent conveying magnetic pole next to said development main magnetic pole is 30° or less.

DETAILED DESCRIPTION OF THE PREFERRED EMBODIMENTS

A preferred embodiment of the present invention is explained in the following. However, the descriptions given here are not be construed to restrict the technical scope of the claims or definitions of terms in any manner.

(Image Forming Apparatus)

Figure 1:
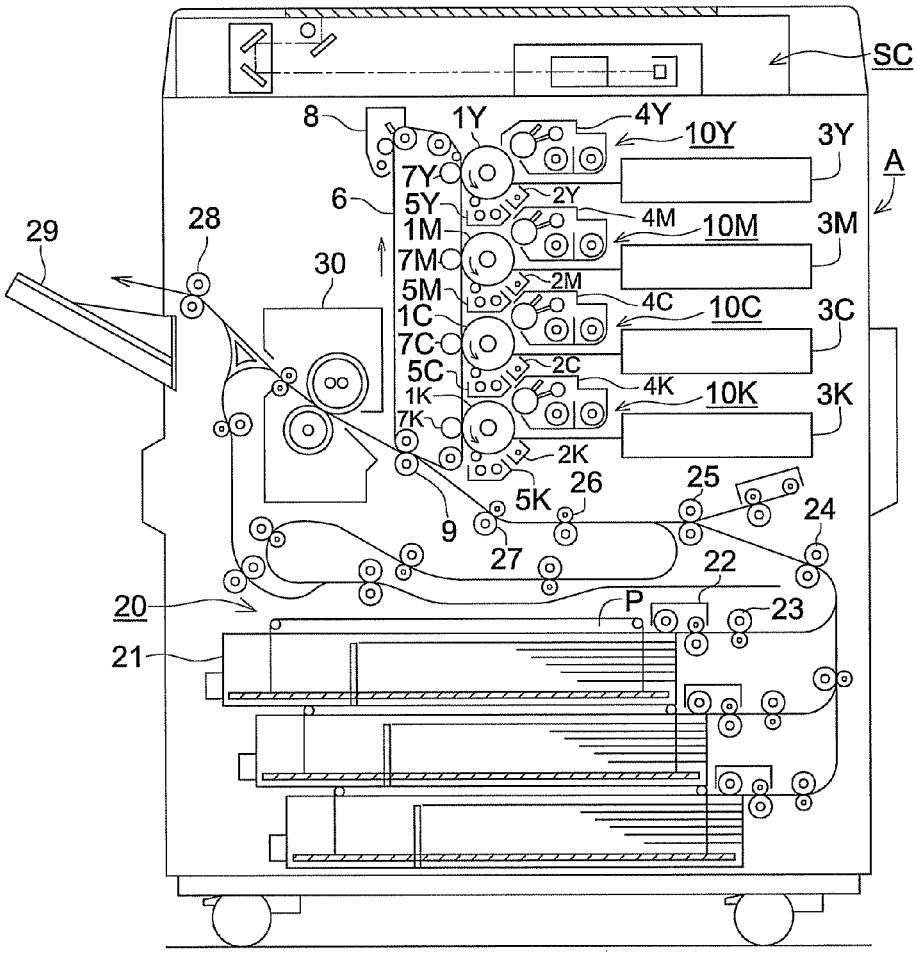
FIG. 1 is a configuration diagram of an image forming apparatus according to the present invention.

FIG. 1 is a configuration diagram of a color image forming apparatus A according to the present invention.

The color image forming apparatus A is one that is called a tandem type color image forming apparatus, and has a plurality of sets of image forming sections 10Y, 10M, 10C, and 10K, a belt shaped intermediate image transfer member 6, a sheet feeding apparatus 20, and a fixing unit 30.

An image reading unit SC is placed in the top part of the color image forming apparatus A. An image on an original document placed on a document table is illuminated in a scanning manner by an optical system of a document image scanning exposure unit of the image reading unit SC, and is read out by a line sensor. An analog signal after photoelectric conversion by the line sensor is subjected to analog signal processing, A/D conversion, shading correction, image compression, and the like, in an image processing section, and is then input to optical writing sections 3Y, 3M, 3C, and 3K.

The image forming section 10Y that forms images of yellow (Y) color has a charging section 2Y, the optical writing section 3Y, a developing unit 4Y, and a cleaning unit 5Y all placed on the periphery of an image carrier 1Y. The image forming section 10M that forms images of magenta (M) color has an image carrier 1M, a charging section 2M, the optical writing section 3M, a developing unit 4M, and a cleaning unit 5M. The image forming section 10C that forms images of cyan (C) color has an image carrier 1C, a charging section 2C, the optical writing section 3C, a developing unit 4C, and a cleaning unit 5C. The image forming section 10K that forms images of black (K) color has an image carrier 1K, a charging section 2K, the optical writing section 3K, a developing unit 4K, and a cleaning unit 5K.

The charging section 2Y and the optical writing unit 3Y, the charging section 2M and the optical writing section 3M, the charging section 2C and the optical writing section 3C, the charging section 2K and the optical writing section 3K constitute latent image forming units.

The symbols 4Y, 4M, 4C, and 4K are the developing units storing two-component developing agents made of a small particle diameter toner and carrier of the colors yellow (Y), magenta (M), cyan (C), and black (K), respectively.

The intermediate image transfer member 6 is passed over a plurality of rollers and is supported in a rotatable manner.

The images of different colors formed by the image forming sections 10Y, 10M, 10C, and 10K are successively transferred onto the rotating intermediate image transfer member 6 by primary transfer by primary transfer sections 7Y, 7M, 7C, and 7K, thereby forming a synthesized color image.

Recording sheets P stored inside a sheet feeding cassette 21 of the sheet feeding apparatus 20 are fed by a three stage sheet feeding section (first sheet feeding section) 22, passed through sheet feeding rollers 23, 24, 25, and 26, and registration rollers (second sheet feeding section) 27, conveyed to a secondary transfer section 9, and a color image is transferred on to the recording sheet P.

Further, the three stage sheet feeding cassette 21 placed in parallel in the vertical direction at the bottom part of the color image forming apparatus A each have almost the same configuration. Further, even the three stages of the sheet feeding sections 22 have almost the same configuration. The sheet feeding cassette 21 and the sheet feeding section 22 are collectively called the sheet feeding apparatus 20.

The recording sheet P on to which a color image has been transferred is gripped in the fixing unit 30, and the color toner image (or the toner image) on the recording sheet P is fixed on to the recording sheet P by the application of heat and pressure, and the recording sheet P is placed on a sheet discharge tray 29 outside the color image forming apparatus A by being gripped by sheet discharge rollers 28.

On the other hand, after the color image has been transferred on to the recording sheet P by the secondary transfer section 9, the intermediate image transfer member 6 that has been separated away from the recording sheet P has the residual toner remaining on it removed by a cleaning section 8.

(Configuration of the Image Forming Apparatus)

Color image forming apparatus: A4 sheet, full color, 51 sheets per minute output, tandem type full color copying machine (Konica-Minolta 8050 (Registered Trademark), see FIG. 1).

Image formation line speed (L/S): 220 mm/sec

Photoreceptor drum diameter: 60 mmϕ. Pthalocyanine pigment was dispersed in polycarbonate and was coated as a semiconductor layer. A thickness of a photoreceptor layer including a charge transport layer was 25 μm.

Potential of non-imaging part of the photoreceptor: Feedback control by detecting using a potential sensor (the controllable range was −250 V to −900 V), full exposure potential: −45 to 150 V.

Light exposure: Laser scanning method: power of semiconductor laser (LD) is 300 μW.

Further, in the explanation of the full color image forming apparatus A, although the explanations have been given for color image formation, these explanations include even the case of forming monochrome images.

In the following, the image carriers 1Y, 1M, 1C, and 1K are referred to as the image carrier 1 (written as photoreceptor 1 in the following), and the developing units 4Y, 4M, 4C, and 4K are referred to as the developing unit 4.

(Developing Unit)

Figure 2:
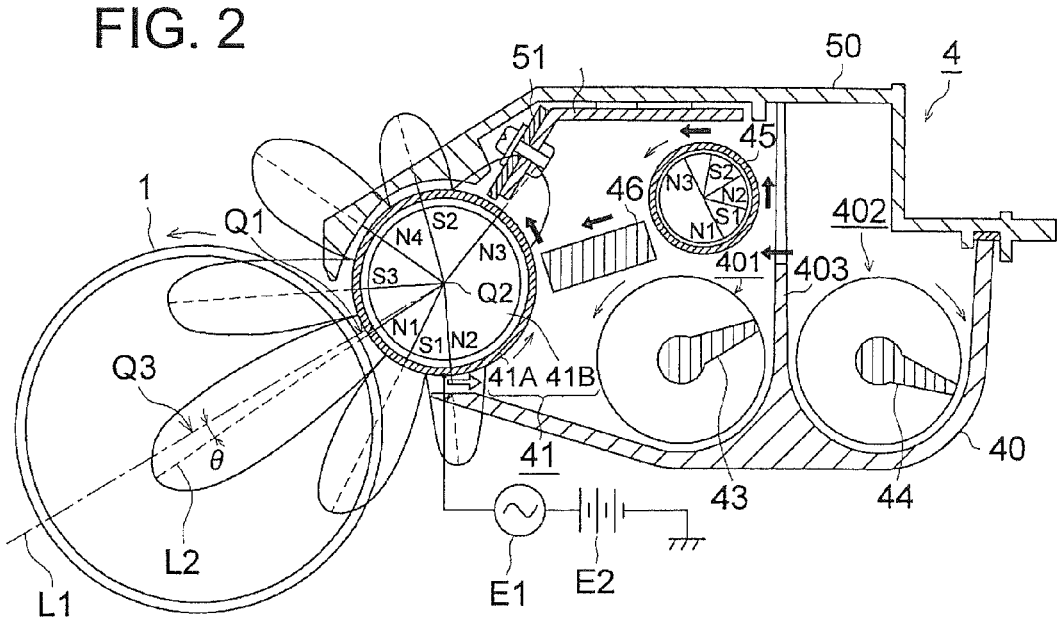
FIG. 2 is a cross-sectional view diagram showing a preferred embodiment of the developing unit according to the present invention.

FIG. 2 is a cross-sectional view diagram showing a preferred embodiment of the developing unit 4 according to the present invention.

The chassis of the developing unit 4 has a two division configuration made of a top part casing 50 at a top part and a bottom part casing 40 at a bottom part, and can be opened and closed.

A development roller 41, a first developing agent stirring and conveying member (hereinafter referred to as the first stirring member) 43, a second developing agent stirring and conveying member (hereinafter referred to as the second stirring member) 44, a developing agent supply roller (hereinafter referred to as the supply roller) 45, and a developing agent guiding member (hereinafter referred to as the guide member) 46 are placed within the bottom part casing 40 of the developing unit 4.

The bottom part casing 40 is made up of a developing agent supply chamber 401 that stores the first stirring member 43 and a developing agent stirring chamber 402 that stores the second stirring member 44. The developing agent supply chamber 401 and the developing agent stirring chamber 402 are formed on the two sides of a separating wall part 403 that stands perpendicular to the bottom part of the bottom part casing 40.

The development roller 41 is made up of a rotatable development sleeve (developing agent carrier) 41A and a fixed magnetic field generating section (magnetic roller) 41B.

At the point of opposition and closeness between the development sleeve 41A and the first stirring member 43, the development sleeve 41A rotates from below towards above, and the first stirring member 43 rotates from above towards below.

The development roller 41 is placed opposite the photoreceptor 1 carrying the electrostatic latent image, and is rotated by a drive means not shown in the figure. An AC voltage from an AC power supply E1 superimposed on a DC voltage from a DC power supply E2 is applied as the development bias to the development sleeve 41A.

The magnetic field generating section 41B is placed inside development sleeve 41A, and has seven magnetic poles N1, N2, N3, N4, S1, S2, and S3. The magnetic pole N1 is the development main magnetic pole, the magnetic pole N2 is the peeling off magnetic pole, and the magnetic pole N3 is the restricting magnetic pole that restricts the quantity of developing agent conveyed on the development roller 41. The magnetic force distribution shown in the figure is obtained because of these seven magnetic poles N1, N2, N3, N4, S1, S2, and S3.

The tip part of a developing agent quantity restricting member 51 is positioned in the neighborhood of the restricting magnetic pole N3 of the magnetic field generating section 41B.

Among the plurality of magnetic poles of the magnetic field generating section 41B, the two neighboring magnetic poles N2 and N3 are made to have the same polarity and form a repelling magnetic field. The peeling off magnetic pole N2 for peeling off the developing agent causes the developing agent on the development sleeve 41A to be peeled off and scattered. The restricting magnetic pole N3 for receiving the developing agent takes up the developing agent supplied by the supply roller 45 and causes it to adhere above the development sleeve 41A.

The first stirring member 43 stirs and transports the developing agent conveyed by the second stirring member 44, and supplies it uniformly to the development roller 41. Both the first stirring member 43 and the second stirring member 44 are helical shaped screw members.

The second stirring member 44 is placed parallel to the first stirring member 43, mixes a fresh toner supplied from a toner replenishing section with the developing agent returned from the development sleeve 41A, stirs the mixture of the fresh toner and developing agent and conveys it to the upstream side of the first stirring member 43.

The first stirring member 43 not only conveys the developing agent in the direction of the axis of rotation, but also discharges the developing agent in a direction almost perpendicular to the axis of rotation.

The developing agent quantity restricting member 51 is made of a magnetic material, is opposite to the restricting magnetic pole N3, and restricts the thickness of the developing agent layer on the development sleeve 41A. The supply roller 45 is provided with a magnetic field generating section having five poles of magnets N1, N2, N3, S1, and S2 placed in a fixed manner, retains and conveys the developing agent supplied by the first stirring member 43, and sends it to the development sleeve 41A.

The guide member 46 has been provided in an inclined manner in the vicinity of the point of opposition and closeness between the development sleeve 41A and the first stirring member 43. The guide member 46 not only separates the developing agent on the lower side that is peeled off from the development sleeve 41A and conveyed in the direction of the hollow arrow shown in FIG. 2, and the developing agent from the upper side that is supplied to the development sleeve 41A, but also, piles up the developing agent conveyed from the supply roller 45 and guides it to the development roller 41. The guide member 46 is formed from a non-magnetic material, for example, from synthetic plastic such as ABS plastic, non-magnetic stainless steel, aluminum alloy, copper alloy, ceramics, and the like.

The developing agent scooped up due to the rotation of the first stirring member 43, after being conveyed by the rotation of the supply roller 45 having a magnetic pole incorporated in it, moves in one direction above the guide member 46 in a streamlined shape, conveyed by the rotating development roller 41, the height of the developing agent is restricted by the developing agent quantity restricting member 51, and is conveyed to the developing area opposite the photoreceptor 1.

(Configuration of the Developing Unit)

Development sleeve 41A: 30 mm diameter, rotation speed 382 rpm

Supply roller 45: 16 mm diameter; rotational speed 200 rpm

Magnetic pole placement of the magnetic field generating section 41B: 7 poles (see FIG. 2)

First stirring member 43, second stirring member 44: 30 mm external diameter, diameter of rotating axle 8 mm, rotational speed 600 rpm, height of helical blades H: 11 mm.

Counter Development Method

Toner density sensor: Sensor detecting the magnetic permeability of the carrier

Development bias: DC bias (DC power supply E2): −200 to −700 V

AC bias (AC power supply E1): 0.5 to 2.0 kVp-p; 2 to 7 Hz (Developing Agent)

Two-component developing agent having an emulsion polymerized toner and a plastic coating carrier: (A high resistance carrier with the particle diameter of carriers being 25 to 45 μm, volume resistivity of carriers being $10^{10}$ to $10^{12}$ Ω-cm, with the toner diameter being 6.5 μm.)

The carrier particles used as small diameter carriers can be measured using a typical laser diffraction type particle size distribution measuring equipment provided with a wet type dispersing unit [HELOS, (Registered Trademark) manufactured by SYMPATECH Corp.]. The volume average particle diameter should preferably be 25 to 45 μm. Further, the carrier resistance should desirably be a volume resistivity of $10^{1o}$ to $10^{12}$ Ω-cm, and the method of measurement is that of using the carriers that have been left for 12 hours in an environment of 25° C. and 50% RH, filling the particles in between parallel electrodes, and measuring the height H (cm). Next, in the condition in which a constant load (of 39.2 kPa) has been applied, a DC voltage of 1000 V is applied, and the current I (A) is measured after 30 seconds, and the resistance is calculated using the following equation.

When the measurement environment is 25° C. and 50% RH, the resistivity (Ωcm)=1000/(I×H)

It is desirable that the particle count average particle diameter is 5.0 to 6.5 μm when the toner diameter is measured using a Coulter counter TA (Registered Trademark) or a Coulter Multisizer (Registered Trademark, and manufactured by Coulter Corp.).

Among these two-component development agents, although the magnetic carrier has almost the same characteristics for all the four colors, the toner characteristics are different for the colors yellow (Y), magenta (M), cyan (C), and black (K). In other words, the black toner is made up of carbon black, and the like, and since it has conductivity with a low electrical resistance compared to the colored toners (Y, M, C), its development characteristics are different from the other color toners.

Preferred Embodiment

In the developing unit shown in FIG. 2, Q1 is the closest part between the development sleeve 41A and the photoreceptor 1. A common normal line connecting a center of rotation Q2 of the development sleeve 41A with a center of rotation Q3 of the photoreceptor 1 is taken as L1, and a normal line of the development main magnetic pole N1, that is, the normal line representing the maximum magnetic flux density of the development main magnetic pole N1, is taken as L2. An angle between the common normal line L1 and the normal line L2 is taken as θ. Further, in the developing unit 4K having the black developing agent, since it is difficult for outline character back edge density unevenness to occur, the developing main magnet N1 is placed at a position near the effective closest part Q1 from the point of view of particle shape or "sweeping line" images.

(Cause of Generation of Outline Character Back Edge Density Unevenness)

Figure 3:
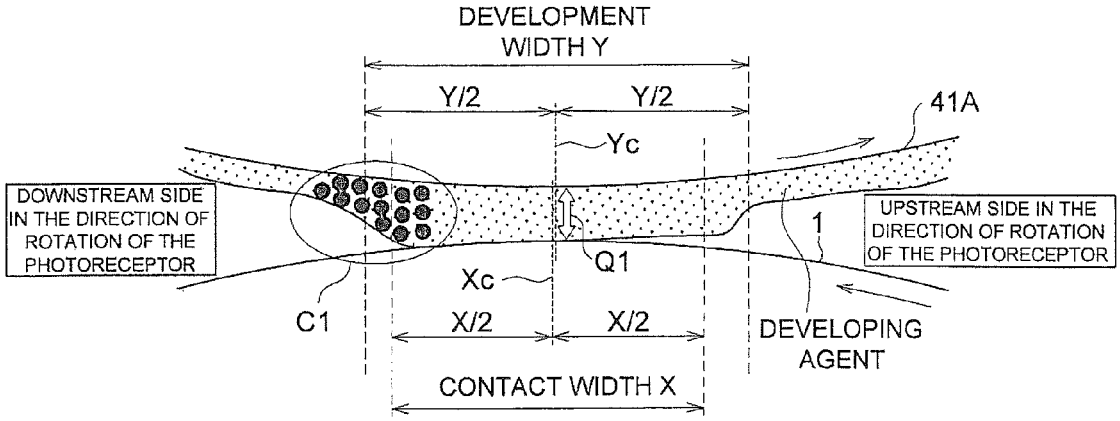
FIG. 3 PRIOR ART
FIG. 3 is an enlarged schematic cross-sectional view diagram of a development area in a conventional counter development method.

FIG. 3 is an enlarged schematic cross-sectional view diagram of the development area in a conventional counter development method.

In the case of the counter development method, in the development area, the development sleeve 41A and the photoreceptor 1 are moving in opposite directions (the development sleeve 41A rotates in the anticlockwise direction as shown in the figure).

The cause of generation of outline character back edge density unevenness is explained using the schematic diagram of FIG. 3. In the case of the counter development method, in the development area, the development sleeve 41A is rotated in a direction opposite to that of the photoreceptor 1. Here, the contact width X in the figure indicates the width along which the developing agent conveyed on top of the development sleeve 41A is contacting with the surface of the photoreceptor 1, and the development width Y indicates the width over which development is being made by transferring of the toner on the development sleeve 41A onto the photoreceptor 1 due to the application of the bias voltage.

By applying an alternating electric field (an AC bias superimposed on a DC bias), the toner in the development area vibrates between the development sleeve 41A and the photoreceptor 1 due to the AC electric field, thereby causing development, and hence it becomes possible to make the development width Y larger than the contact width X (X<Y).

Outline character back edge density unevenness is presumed to be occurring at the outlet side of this development area (the downstream side along the direction of rotation of the photoreceptor 1).

The mechanism of generation is considered to be that, at the time that the developed toner image leaves the development area, if the bristles of the developing agent are large near the outlet of the development area, the surface of the developing agent bristles entering the development area get affected by the potential of the unexposed part, the toners move towards the development sleeve 41A, thereby making the area carrier rich. Because of this, the carriers having charges of a polarity opposite to that of the toner attract the developed toner image thereby scratching it up reducing the density and hence generating this phenomenon.

In other words, as is shown by the elliptical part C1 in FIG. 3, in the upstream side in the direction of rotation of the development sleeve 41A, scratching up by the bristles of the developing agent is made of the developed toner image at the back edge of the development width Y.

In particular, as was explained earlier, when small particle diameter and high resistance carriers are used for the sake of higher durability and high image quality, it is considered that this phenomenon can occur easily because the electric charge of the carriers opposite in polarity to that of the toner becomes large after the toner has been developed.

(Measures for Improving Outline Character Back Edge Density Unevenness)

Figure 4:
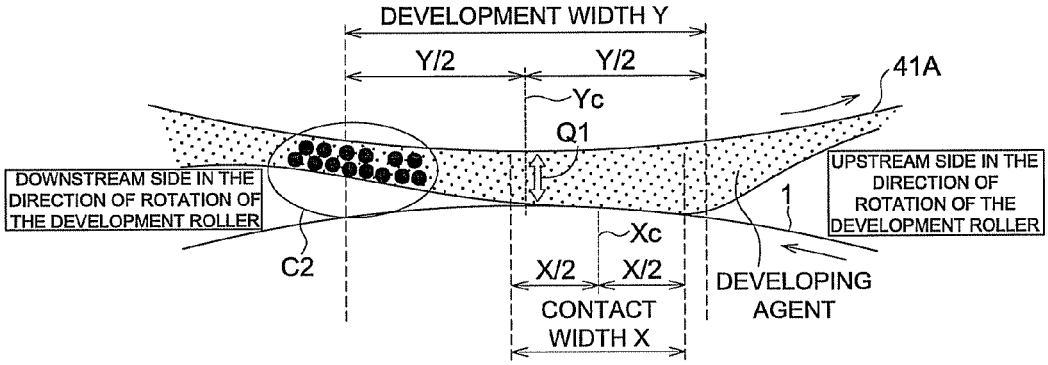
FIG. 4 is an enlarged schematic cross-sectional view diagram of a development area in a counter development method of the present preferred embodiment.
Figure 5:
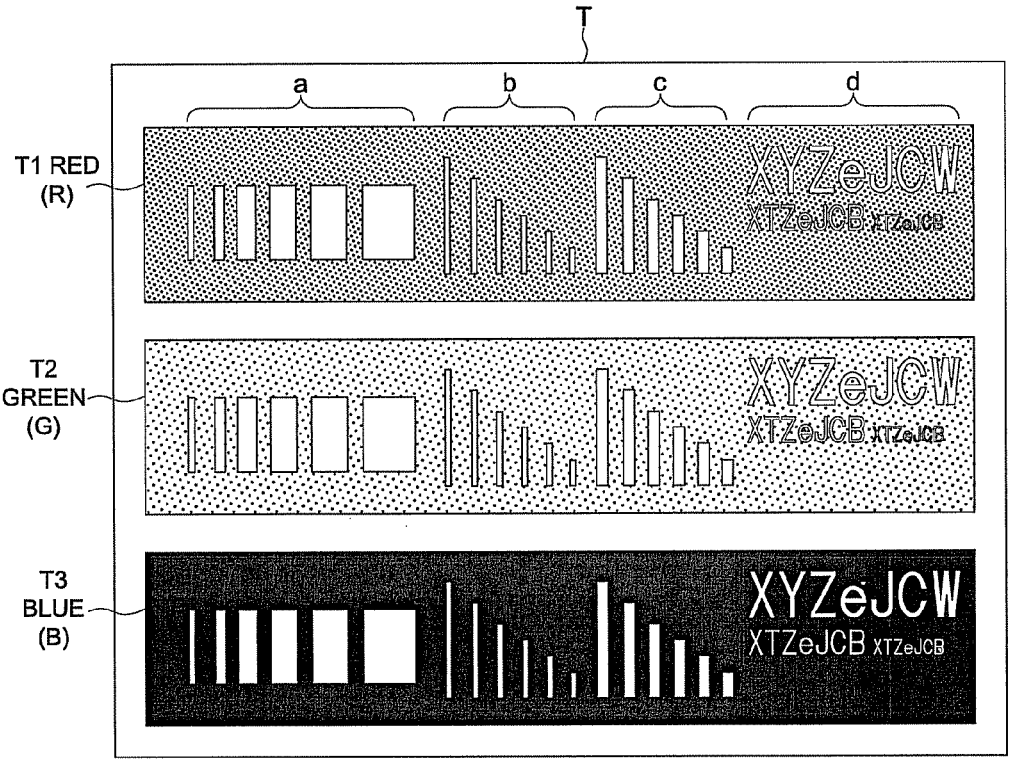
FIG. 5 is a test chart for verifying the generation of outline character back edge density unevenness.

A preferred embodiment of the present invention is explained here based on FIG. 4 and FIG. 5.

FIG. 4 is an enlarged schematic cross-sectional view diagram of the development area in the counter development method of the present preferred embodiment.

It is sufficient to eliminate the "scratching up" at the back edge of the development width in order to improve the outline character back edge density unevenness. Therefore, at the back edge of the development width Y, it is good to make the edge of the contact width X distant than the edge of the development width Y, thereby preventing contact with the bristles of the developing agent.

In the counter development method in which it becomes possible to use still higher resistance carriers, by setting the contact width narrower than the development width Y, and also setting the center position Xc of the contact width X more on the upstream side in the direction of rotation of the photoreceptor 1 than the center position Yc of the development width Y, it becomes possible to prevent the bristles of the developing agent on the downstream side in the direction of rotation of the photoreceptor 1 in the development area as is shown in the figure, and to suppress the scratching up of the toner image.

In other words, as is shown by the elliptical part C2 in FIG. 4, in the upstream side in the direction of rotation of the development sleeve 41A, by making the edge part of the development width Y and the edge part of the contact width X large, it is possible to solve the scratching of the toner image by the bristles of the developing agent.

Here, verification was carried out as to how small the contact width X has to be made with respect to the development width Y in order to make the scratching of the toner image disappear.

(Verification 1)

FIG. 5 is a test chart T for verifying the generation of outline character back edge density unevenness.

Test chart T has the chart sections T1, T2, and T3 made of the three fundamental colors of light (R, G, and B). The chart section T1 is one in which outline patterns or outline characters are formed on a red (R) background. The chart section T2 is one in which outline patterns or outline characters are formed on a green (G) background. The chart section T3 is one in which outline patterns or outline characters are formed on a blue (B) background.

Each of the chart sections T1, T2, and T3 have outline patterns a with the same lengths but with different widths, the outline patterns b with narrow widths but different lengths, and the outline patterns c with large widths but different lengths, and the outline patterns d with different character sizes.

Using the test chart T having these chart sections T1, T2, and T3 is used as the original document, and color images of three colors were formed on recording sheets P using the color image forming apparatus A. The result of generation of outline character back edge density unevenness in these color images of three colors was verified.

TABLE 1

| Ratio of the contact width to the development width (%) | Outline character back edge density unevenness evaluation rank: Center position of the contact width is set on the upstream side | Outline character back edge density unevenness evaluation rank: Center position of the contact width is set on the downstream side |
|---|---|---|
| 150 | F | F |
| 100 | E | F |
| 90 | C | F |
| 80 | C | E |
| 70 | A | C |
| 60 | A | C |
| 50 | A | C |

In Table 1, the outline character back edge density unevenness evaluation rank is shown for the ratio of the contact width to the development width (%) and the correlation with the position θ of the development main magnetic pole.

Further, the setting on the downstream side in Table 1 means that the center position Xc of the contact width X is set to be more on the downstream side in the direction of rotation of the photoreceptor 1 than the center position Yc of the development width Y.

Further, in Table 1 and in Tables 2 and 3 described later, the mark A indicates that there was absolutely no generation of outline character back edge density unevenness in the test chart T, and that good images were obtained. The mark B indicates that in the test chart T, density unevenness occurred in the smallest characters of pattern d. The mark C indicates that in the test chart T, outline character back edge density unevenness occurred in the pattern d. The mark D indicates that in the same test chart T, outline character back edge density unevenness occurred in pattern b and pattern d. The mark E indicates that in the same test chart T, outline character back edge density unevenness occurred in patterns b, c, and d. The mark F indicates that in the same test chart T, outline character back edge density unevenness occurred entirely in patterns a to d.

In Table 1, when the center position Xc of the contact width X is set to be more on the downstream side in the direction of rotation of the photoreceptor 1 than the center position Yc of the development width Y (see FIG. 3), outline character back edge density unevenness occurred even when the ratio of the contact width X to the development width Y was changed.

In contrast with this, as is shown in Table 1, when the center position Xc of the contact width X is set to be more on the upstream side in the direction of rotation of the photoreceptor 1 than the center position Yc of the development width Y, outline character back edge density unevenness occurred when the ratio (X/Y) of the contact width X to the development width Y was larger than 70%. However, outline character back edge density unevenness did not occur when the ratio (X/Y) of the contact width X to the development width Y was 70% or less.

In other words, by making the center position Xc of the contact width X on the upstream side of the direction of rotation of the photoreceptor 1, and making the ratio of the contact to the development width Y less than or equal to 70%, it is possible to make sure that the bristles of the toner do not contact the surface of the photoreceptor 1 at the outlet of the development area of the developed toner image, thereby suppressing the scratching of the toner image, and to obtain good images without any density unevenness.

The results did not change even when the other conditions such as the development bias were changed.

(Verification 2)

Figure 6:
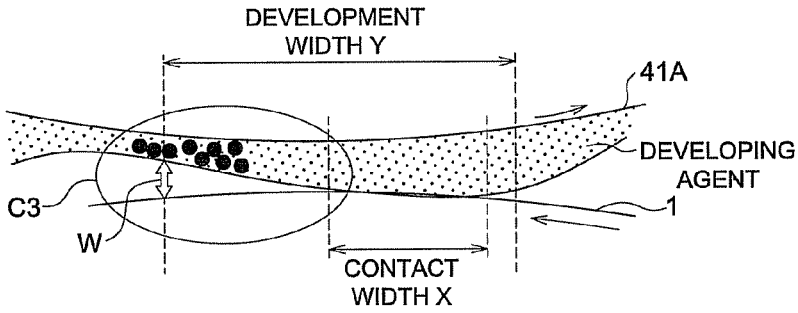
FIG. 6 is an enlarged schematic cross-sectional view diagram on a downstream side in a direction of rotation of a photoreceptor in a development area.

FIG. 6 is an enlarged schematic cross-sectional view diagram on the downstream side in the direction of rotation of the photoreceptor 1 in the development area.

W is the distance from the tip of the developing agent bristles in the developing width carrier section in the downstream side in the direction of rotation of the photoreceptor 1 to the surface of the photoreceptor 1. The elliptical part C3 indicates the status of the developing agent bristles in the downstream side in the direction of rotation of the photoreceptor 1. Here, the relationship between the developing agent bristles and the image back edge part was studied from the point of view of the distance W.

The outline character back edge density unevenness, the graininess and development characteristics were evaluated while changing the value of the distance W in FIG. 6, and the optimum distance W was verified.

TABLE 2

| Expt No. | Distance W (μm) | Evaluation of outline character back edge density unevenness | Graininess | Development characteristics |
|---|---|---|---|---|
| 1 | 0 | E | A | A |
| 2 | 100 | C | A | A |
| 3 | 200 | A | A | A |
| 4 | 300 | A | A | A |
| 5 | 600 | A | A | A |
| 6 | 900 | A | A | A |
| 7 | 1200 | A | A | A |
| 8 | 1500 | C | C | C |
| 9 | 1800 | C | E | C |
| 10 | 3000 | C | F | E |

Table 2 shows the result of the generation of outline character back edge density unevenness, graininess of the toner image, and the development characteristics when the distance W was set from 0 to 3000 μm. The evaluation marks A, C, E, and F indicate the levels that were already explained in reference to Table 1.

Regarding the magnitude of the distance W, outline characters become bad when W=0 μm which implies that either the edge of the contact width X and the edge of the development width Y are almost at the same position or the contact width X is larger than the development width Y because the bristles of the developing agent at the edge of the development width come into contact with the photoreceptor 1 thereby causing scratching of the toner image.

If a distance W of 200 μm or more can be acquired, since it becomes difficult for the scratching of the toner image by the bristles of the developing agent to occur, although the occurrence of outline character back edge density unevenness gets improved, if developing agent bristles are formed in the development area so as to extend over a length of 1500 μm or more in the density of the developing agent bristles becomes rare in the development area, and the graininess becomes bad. In addition, since there is even the trend of the development characteristics becoming poor and the uniformity of bland images becomes poor, even the reproducibility of outline characters inside a bland image decreases. Therefore, it is considered that the distance W should desirably be in the range of 200 μm or more but less than or equal to 1200 μm (Verification 3)

Figure 7:
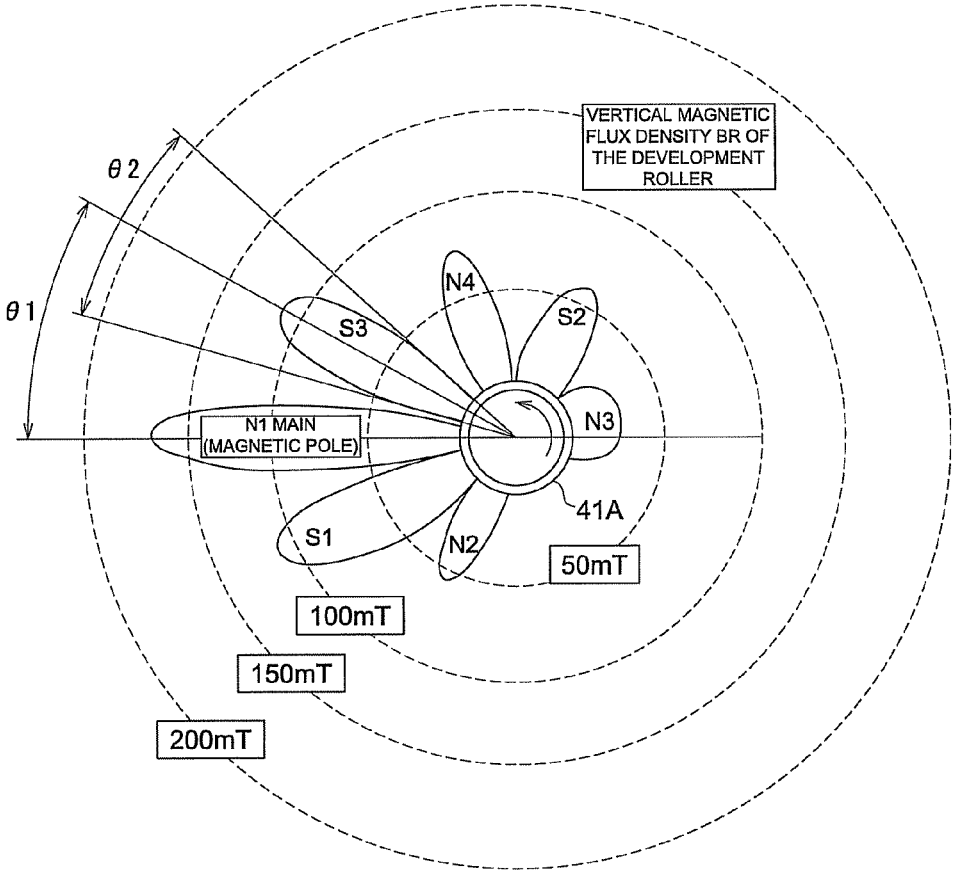
FIG. 7 is a diagram showing a vertical magnetic flux density of a development roller.
Figure 8:
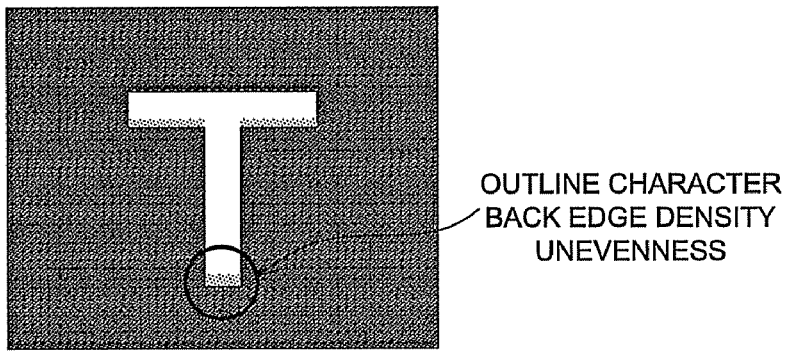
FIG. 8 is a diagram for explaining outline character back edge density unevenness.

FIG. 7 is a diagram showing the vertical magnetic flux density of the development roller 41.

A vertical magnetic flux density is formed above the development roller 41 due to the development main magnetic pole N1, the magnetic pole S3 immediately above in the upstream direction, and due to the other magnetic poles.

The angle between the development main magnetic pole N1 and the magnetic pole S3 immediately above in the upstream direction is denoted by θ1, and the angle of the half-value width of the magnetic pole S3 immediately above in the upstream direction is denoted by θ2.

TABLE 3

| Angle between the development main magnetic pole and the magnetic pole immediately above in the upstream direction θ1 (°) | Angle of the half-value width of the magnetic pole immediately above in the upstream direction θ2 (°) | Main magnetic pole position θ (°) | *1 | Main magnetic pole position θ (°) | *1 |
|---|---|---|---|---|---|
| 20 | 40 | +4 | E | −4 | C |
| | 35 | +4 | E | −4 | C |
| | 30 | +4 | E | −4 | C |
| 25 | 40 | +4 | E | −4 | C |
| | 35 | +4 | E | −4 | C |
| | 30 | +4 | E | −4 | A |
| 30 | 40 | +4 | E | −4 | B |
| | 35 | +4 | E | −4 | C |
| | 30 | +4 | E | −4 | A |
| 35 | 40 | +4 | F | −4 | B |
| | 35 | +4 | E | −4 | C |
| | 30 | +4 | E | −4 | A |
| 40 | 40 | +4 | F | −4 | E |
| | 35 | +4 | E | −4 | E |
| | 30 | +4 | E | −4 | D |
| 20 | 40 | 0 | C | −6 | C |
| | 35 | 0 | C | −6 | C |
| | 30 | 0 | C | −6 | C |
| 25 | 40 | 0 | E | −6 | C |
| | 35 | 0 | C | −6 | C |
| | 30 | 0 | B | −6 | A |
| 30 | 40 | 0 | E | −6 | D |
| | 35 | 0 | E | −6 | C |
| | 30 | 0 | C | −6 | A |
| 35 | 40 | 0 | F | −6 | D |
| | 35 | 0 | E | −6 | C |
| | 30 | 0 | C | −6 | A |
| 40 | 40 | 0 | F | −6 | E |
| | 35 | 0 | F | −6 | E |
| | 30 | 0 | E | −6 | D |
| 20 | 40 | −2 | C | −8 | C |
| | 35 | −2 | C | −8 | C |
| | 30 | −2 | C | −8 | C |
| 25 | 40 | −2 | E | −8 | C |
| | 35 | −2 | B | −8 | C |
| | 30 | −2 | A | −8 | A |
| 30 | 40 | −2 | E | −8 | D |
| | 35 | −2 | C | −8 | C |
| | 30 | −2 | A | −8 | A |
| 35 | 40 | −2 | F | −8 | D |
| | 35 | −2 | C | −8 | C |
| | 30 | −2 | B | −8 | B |
| 40 | 40 | −2 | F | −8 | E |
| | 35 | −2 | E | −8 | E |
| | 30 | −2 | E | −8 | D |

*1: Evaluation of outline character back edge density unevenness

Table 3 shows the result of evaluating the outline character back edge density unevenness when the position of the development main magnetic pole is set variably in the six steps of +4°, 0°, −2°, −4°, −6°, and −8° under a condition that the angle θ1 between the development main magnetic pole and the magnetic pole immediately above in the upstream direction is set variably in the range of 20° to 40° and the angle θ2 of the half-value width of the magnetic pole S3 immediately above in the upstream direction is set variably in the range of 30° to 40°. Further, the position of the main magnetic pole N1 is indicated in the table, taking the closest part Q1 where the development sleeve 41A and the photoreceptor 1 are opposite to each other, as "+" when the setting is on the upstream side in the direction of rotation of the development sleeve 41A and as "−" when the setting is on the downstream side. In addition, in Table 3, B indicates that density unevenness occurred in the back edge of the smallest character in pattern d of the test chart T of FIG. 5, and D indicates that outline character back edge density unevenness occurred in the patterns b and d of the same test chart T. The marks A, C, E, and F indicate the levels as has already been described earlier.

In order to suppress the scratching of the toner image on the downstream side of the photoreceptor 1 in the development area, it is sufficient to suppress the scratching of the toner image by flattening the developing agent bristles on the downstream side of the photoreceptor 1.

As is shown in FIG. 2, in order to flatten the developing agent bristles between the development main magnetic pole N1 and the magnetic pole S3 immediately above in the upstream direction, we carried out studies by varying the angle between the development main magnetic pole N1 and the magnetic pole S3 immediately above in the upstream direction, the angle of the half-value width of the magnetic pole immediately above the development main magnetic pole in the upstream direction, and the position of the development main magnetic pole.

From the above results, since it is good to flatten more uniformly the bristles between the development main magnetic pole N1 and the magnetic pole S3 immediately above in the upstream side, it is a good direction in countering outline character back edge density unevenness to make narrow the angle between these two magnetic poles, and to make the bristles dense by narrowing the magnetic pole width of the magnetic pole S3 immediately above on the upstream side. However, the fact that the level is deteriorating when the angle between the development main magnetic pole N1 and the magnetic pole S3 immediately above in the upstream direction is narrowed down up to 20° is considered to be because the bristles of the magnetic pole S3 immediately above in the upstream direction themselves are having a slight effect on the scratching of the toner image.

From the above, as a concrete means for constituting the development nip section, among the magnetic poles placed inside the development roller 41, the position of the development main magnetic pole N1, and the angle with the magnetic pole S3 immediately above in the upstream side in the direction of rotation of the development roller 41 is set to within the range of 25° to 35°, and the angle θ2 of the half-value width with respect to the magnetic pole S3 immediately above in the upstream side in the direction of rotation of the development roller 41 is made 30° or less. By doing this, the magnetic flux density along the horizontal direction becomes high between development main magnetic pole N1 and the magnetic pole S3 immediately above in the upstream side, thereby making it possible to make the developing agent bristles lie flat.

Next, the angle θ1 was set from 25° to 35°, the effect of setting the angle θ formed by the development main magnetic pole N1 with the common normal line L1 for the data of the angle θ2 or 30° or less was verified.

When the angle θ formed by the development main magnetic pole N1 with the common normal line L1 (see FIG. 2) is set to +4° from Table 3 (upstream side in the direction of rotation of the developing agent), the level of outline character back edge density unevenness becomes bad in any of the cases (marks E, F). In other words, it is clear that scratching of the toner image can occur easily because the bristles of the developing agent come in the vicinity of the downstream side in the direction of rotation of the photoreceptor 1 in the development area where scratching of the toner image is taking place.

Further, when the angle θ of the development main magnetic pole is set to 0°, outline character back edge density unevenness occurred in any combination of the conditions (marks, C, E, F).

Further, when the angle θ of the development main magnetic pole is set to −2°, there is improvement in the outline character back edge density unevenness. However, some outline character back edge density unevenness is occurring at an angle of 135°.

On the other hand, occurrence of outline character back edge density unevenness was not observed in any combination of the conditions when the angle θ of the development main magnetic pole is set to −4° and −6° (mark A).

Further, when the angle θ of the development main magnetic pole is set to −8°, although there is improvement in the outline character back edge density unevenness, some outline character back edge density unevenness is occurring when the angle θ1 is set to 35°.

In this manner, since the part in which the bristles are flattened come to the downstream side in the direction of rotation of the photoreceptor 1 by taking the position of the development main magnetic pole to the angles −2° and −4° in the direction of rotation of the development sleeve 414, it is considered that scratching of the toner image becomes small, and outline character back edge density unevenness gets resolved. In more specific terms, outline character back edge density unevenness gets resolved by taking towards the downstream side by an angle of −4° or more. However, if this angle is taken up to −8°, the developing agent bristles within the development area become too "rare" causing graininess, and as a result outline character back edge density unevenness occurs. Therefore, the angles of −4° to −6° are desirable as the appropriate range of the position of the development main magnetic pole N1.

Therefore, it is clear that, by setting the angle θ1 to a value in the range of 25° to 35°, setting the angle θ2 to 30° or less, and setting the position of the development main magnetic pole N1 of the development roller 41 to an angle of 4° to 6° towards the downstream side in the direction of rotation of the development roller 41, the above part in which the developing agent bristles are lying flat can be taken to the downstream side in the direction of rotation of the photoreceptor 1 in the development area described earlier (the toner image outlet side in the development area). As a result, it becomes difficult for scratching of the toner image to occur, and it is possible to suppress the occurrence of outline character back edge density unevenness.

What is claimed is:

1. An image forming apparatus comprising an image carrier for forming an electrostatic latent image on a surface thereof and a developing unit for developing the electrostatic latent image on said image carrier with a two-component developing agent, wherein the developing unit comprises:

a developing agent carrier for developing the electrostatic latent image to form a visible image, wherein said developing agent carrier is disposed opposite to said image carrier with a gap; having inside thereof a development main magnetic pole for forming a bristle of a magnetic brush; and a plurality of magnetic poles for conveying the developing agent, wherein the developing unit performs a counter type contact developing method in which said image carrier and said developing agent carrier are moved in mutually opposite directions at a development area, the bristle of the magnetic brush is formed by the two-component developing agent on the surface of said developing agent carrier, and an alternating electric field having a DC component and an AC component superimposed on each other is used as a development bias applied to said developing agent carrier, and wherein, the development area is formed so that, a contact width of the bristle of the magnetic brush formed by said development main magnetic pole contacting on said image carrier is 70% or less with respect to a development width in which a toner on the surface of said developing agent carrier is transferred on to said image carrier, and a center position of the contact width is positioned on an upstream side with respect to a center position of the development width in a rotation direction of said image carrier.

2. An image forming apparatus comprising an image carrier for forming an electrostatic latent image on a surface thereof and a developing unit for developing the electrostatic latent image on said image carrier with a two-component developing agent, wherein the developing unit comprises:

a developing agent carrier for developing the electrostatic latent image to form a visible image, wherein said developing agent carrier is disposed opposite to said image carrier with a gap; having inside thereof a development main magnetic pole for forming a bristle of a magnetic brush; and a plurality of magnetic poles for conveying the developing agent, wherein the developing unit performs a counter type contact developing method in which said image carrier and said developing agent carrier are moved in mutually opposite directions at a development area, the bristle of the magnetic brush is formed by the two-component developing agent on the surface of said developing agent carrier, and an alternating electric field having a DC component and an AC component superimposed on each other is used as a development bias applied to said developing agent carrier, and wherein the development area, in which a toner on the developing agent carrier is transferred on to said image carrier, is formed so that a distance from a surface of the bristle of the magnetic brush at an end part of a downstream side of the development area with respect to a rotation direction of the image carrier to the surface of the image carrier is 200 mm to 1200 mm.

3. An image forming apparatus comprising an image carrier for forming an electrostatic latent image on a surface thereof and a developing unit for developing the electrostatic latent image on said image carrier with a two-component developing agent, wherein the developing unit comprises:

a developing agent carrier for developing the electrostatic latent image to form a visible image, wherein said developing agent carrier is disposed opposite to said image carrier with a gap; having inside thereof a development main magnetic pole for forming a bristle of a magnetic brush; and a plurality of magnetic poles for conveying the developing agent, wherein the developing unit performs a counter type contact developing method in which said image carrier and said developing agent carrier are moved in mutually opposite directions at a development area, the bristle of the magnetic brush is formed by the two-component developing agent on the surface of said developing agent carrier, and an alternating electric field having a DC component and an AC component superimposed on each other is used as a development bias applied to said developing agent carrier, and wherein said development main magnetic pole is provided at upstream of a position in a rotation direction of said image carrier, at which position the surface of the image carrier is closest to the developing agent carrier, and wherein said development main magnetic pole and a developing agent conveying magnetic pole that is next to said development main magnetic pole at an upstream side in a rotation direction of said developing agent carrier make an angle of 25° to 35°, and a half-value width of the developing agent conveying magnetic pole next to said development main magnetic pole is 30° or less.

4. The image forming apparatus described in claim 3, wherein said development main magnetic pole is disposed upstream of a position at which said image carrier is closest to said developing agent carrier with respect to the rotation direction of said image carrier.

5. The image forming apparatus described in claim 3, wherein said development main magnetic pole is disposed at a position within a range of 4° to 8° from a position at which said image carrier is closest to said developing agent carrier with respect to the rotation direction of said image carrier.

* * * * *